US005878445A

United States Patent [19]

Suderski

[11] Patent Number: 5,878,445

[45] Date of Patent: Mar. 9, 1999

[54] DISPOSABLE RECEPTACLE FOR ORAL BODY FLUIDS

[76] Inventor: Jeff J. Suderski, 17938 Glenledi Dr., Ho., Tex. 77084

[21] Appl. No.: 822,992

[22] Filed: Mar. 21, 1997

[51] Int. Cl.[6] ..... A61J 19/00

[52] U.S. Cl. ..... 4/258; D24/123

[58] Field of Search ..... 4/258, 619, 621, 4/144.2, 451, 450; 604/317; D24/123, 121

[56] References Cited

U.S. PATENT DOCUMENTS

| | | | |
|---|---|---|---|
| D. 44,448 | 8/1913 | Meinecke | D24/123 |
| D. 46,262 | 8/1914 | Meinecke | D24/123 |
| D. 197,106 | 12/1963 | Laubsch | D24/123 |
| 1,061,769 | 5/1913 | Meinecke | 4/258 X |
| 3,611,450 | 10/1971 | Bost | 4/621 X |
| 3,625,654 | 12/1971 | Van Duyne | 4/144.2 X |
| 5,445,292 | 8/1995 | Slomski et al. | 4/144.2 X |

FOREIGN PATENT DOCUMENTS

| | | | |
|---|---|---|---|
| 790356 | 11/1935 | France | 4/258 |

*Primary Examiner*—David J. Walczak
*Assistant Examiner*—Kathleen J. Prunner
*Attorney, Agent, or Firm*—Gunn & Associates, P.C.

[57] ABSTRACT

A patient basin has a bottom, a sloping front wall, and an upstanding back wall. The front edge is curved to fit below the patient's mouth. The back wall includes an integral vertical grip defined by a pair of finger receiving notches.

17 Claims, 2 Drawing Sheets

DISPOSABLE RECEPTACLE FOR ORAL BODY FLUIDS

BACKGROUND OF THE DISCLOSURE

The present disclosure is directed to a portable receptacle which is the type of device normally issued to a patient in a hospital. It is a device which enables the patient to spit up things during a hospital stay. There is a range of convalescent conditions in which a person is too well to have such a problem and there is also a range of medical difficulties which are so severe the patient is either in a coma or is so sick that they are not at risk for vomiting. Patients in the latter condition are provided with respirator tubes in their throat, an oxygen line in their nose, and stomach evacuation lines to assure they do not vomit. It is possible for an extremely sick person to vomit and literally drown in their own juices! Short of that extreme condition, there is a common condition in which the person may be sufficiently sick and yet sufficiently alert that they easily recognize the onset of conditions leading to spitting or vomiting connected with the gag reflex of the patient. In a wide range, there is the possibility, indeed a rather common probability, that the person will throw up or vomit or be continuously spitting to clear their mouth and throat. The medical conditions in which these circumstances can occur range widely and impact many patients, perhaps a high percentage of patients when hospitalized. Sometimes, the gag reflex is overwhelmed with narcotics or other suppressants. Sometimes, the patient is permitted to exercise their full range of gagging and choking, it being desirable that the patient actually spit up things in the throat to clear the throat. This may include clearing the throat of mucous or emptying the stomach where vomiting is intentionally induced. Over this wide range of possibilities, the patient may be required to do this intentionally or will do it in a random, even unintended fashion.

Whether intentional or random, the gagging reflex ultimately resulting in spitting or vomiting creates a problem of cleanliness. This is always a problem for the patient. For some it is very embarrassing, and for others it is very painful depending on medical conditions. As one can imagine, there are problems of patient cleanliness including the necessary obligation to change patient clothing including gowns and robes, and perhaps replace sheets and pillow slips on the bed. This increases the cost of hospital care. It may also collaterally expose medical personnel (orderly, nurse or doctor as the case may be) to unwanted diseases which may in fact be endemic in the fluids discharged bodily by the patient.

The present disclosure is directed to a receptacle or container which can be used by the patient. This is intended for use by older patients such as those well advanced in years (geriatric patients 80–90 years of age) who are too weak or frail or not quite mentally alert so attendant personnel are required to hold a basin or container when they spit up small or large quantities. The device can handle small quantities because it is built to handle a large quantity. A large quantity is somewhat relative in definition; it is large dependent on the size of the person and hence dependent on the stomach capacity of the patient. As will be understood, the present disclosure sets forth a basic structure which can be increased or decreased in size dependent on the size of the patient. To this end, it is preferably furnished in two or three sizes, one size being adapted for smaller patients such as children and small women of perhaps 75 to 100 pounds, average size people ranging from 100 to 160 pounds and larger patients ranging from 160 pounds upward. By modest extensions of the dimensions, a much larger capacity can be obtained.

Without regard to size, the device of the present disclosure is intended for use by nearly every patient admitted to a hospital bed. Some patients simply have no knowledge of their propensity to spit or vomit when ill. Others may know readily because they have been through the exercise many times. This device is intended as a marked improvement over the Emesis basin. That is a basin which has the shape of a kidney and which typically varies over a modest range in size and depth.

It has relatively rounded corners for ease of fabrication when stamped out in a plastic injection molding machine or when formed with male and female dies of plastic sheet stock. Without regard to the mode of fabrication, older basins are not easily used and they are not easily applied by the patient. As a first point, it is noted such basins must be typically grasped by the patient who is required to hold the device ideally in both hands, secured with thumb and fingers. Typically, this requires the thumb and fingers extend over the top lip of the Emesis basin. Even worse, without regard to where the hands are located, when the patient is obligated to sneeze, cough or otherwise spit up a small or much larger quantity, it is often expelled with an unpredictable force and velocity. These events do not gently occur; indeed, they can be accompanied with violent body spasms of the stomach, coughing and sneezing, etc. This may well splatter over the vicinity including the patient's bed.

One purpose of the present disclosure is to set forth a receptacle which can be used to catch the bodily fluids without escape. It enhances and provides greater protection for fluid containment. The out splash or backsplash is held to a minimum. Moreover, in all aspects, spillage from the basin of the present disclosure is difficult. It is much more improbable that spillage will occur. Not only is the device easier to handle before spitting or sneezing, the device is more readily handled during and after the spitting. Thus, it is easier to handle by the patient and attendant medical personnel.

In one aspect, the device of the present disclosure is especially intended for mass production and mass distribution. It is intended for every patient admitted to a hospital. It is relatively inexpensive, and therefore can be discarded without use should the patient be so fortunate not to require this device. On the other hand, it can be used and discarded. It can be used, washed and used again. To this end, the preferred embodiment is a device which is formed of a relatively high molecular weight polymer or copolymer system having the form of sheet plastic which is manufactured by die shaping in a male and female die, or perhaps by blow molding. It will be described as a butterfly bowl realizing that is a generalization with regard to the overall profile or shape. In fact, this constitutes one of the noteworthy aspects of the device. Because the device is shaped resembling a butterfly bowl, this enhances the grip for both the user and the attendant medical personnel. Moreover, this enables the device to nest against both cheeks of a patient, thereby enabling a curved fit against the face so spillage is reduced. This is especially true for patients who are totally or partially reclining.

Another aspect of the present apparatus is the incorporation of a splash guard which is on the back wall or side. This splash guard limits the trajectory especially in violent expulsions. This enables medical attendant personnel to assist with less chance of splashing. Moreover, the splash guard on the back side limits or controls mishaps. The splash guard functions as a back stop to limit broad distribution of the mess that may often arise for some patients. In one aspect, the finger grips are recessed in the back side of the bowl and are just under the splash guard and this enables one handed use and operation of the device. Moreover, it shields or shelters the hand and hence all the fingers of the user such as medical personnel. In this configuration, the device can be stacked in great numbers. It can be made and nested. It is preferably a water tight structure which enables the user to limit splashing and spillage.

BRIEF DESCRIPTION OF THE DRAWINGS

So that the manner in which the above recited features, advantages and objects of the present invention are attained and can be understood in detail, a more particular description of the invention, briefly summarized above, may be had by reference to embodiments thereof which are illustrated in the appended drawings.

DETAILED DESCRIPTION OF THE PREFERRED EMBODIMENT

Figure 1:
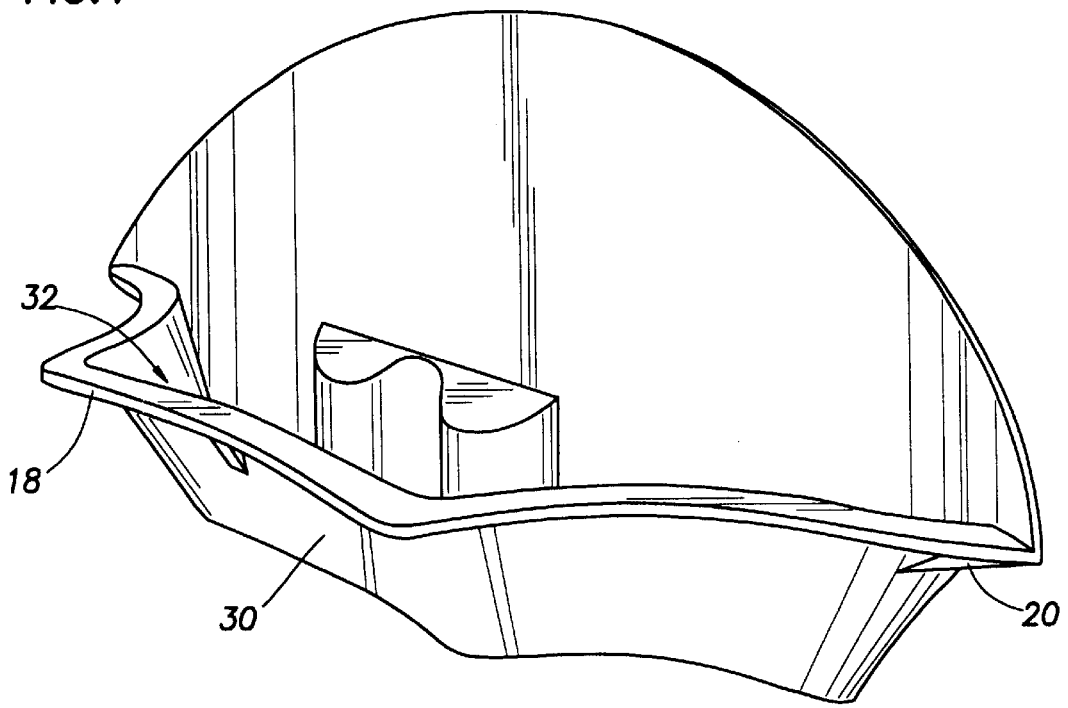
FIG. 1 is a perspective view showing the butterfly basin of the present disclosure from the front with an upstanding back splash wall.
Figure 2:
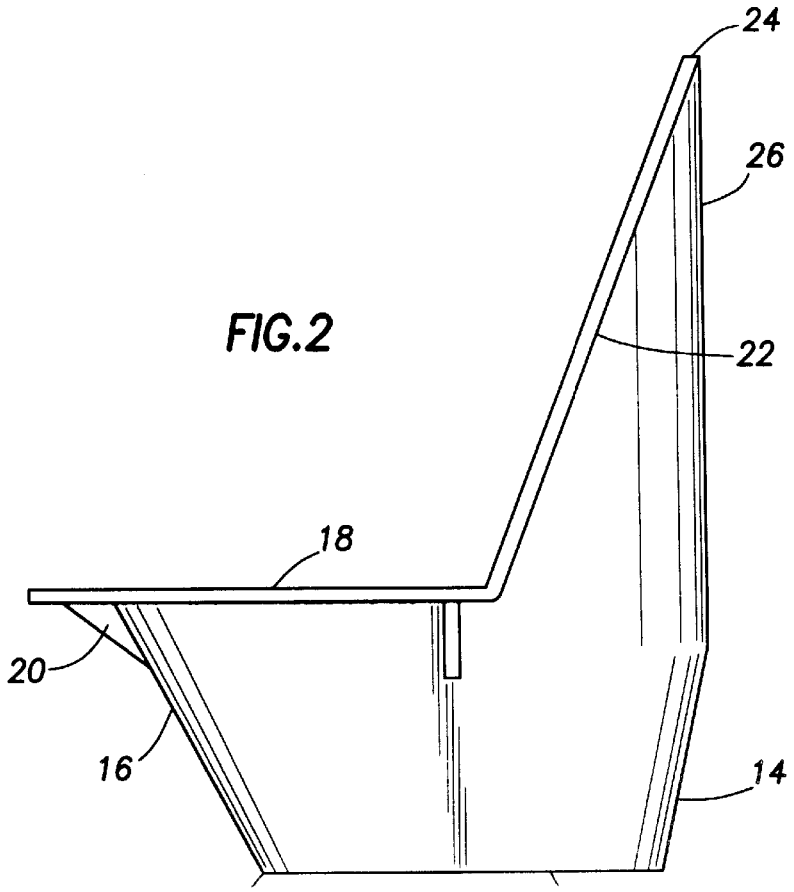
FIG. 2 is a side view of the butterfly shaped basin of FIG. 1 showing an upstanding back stop which limits splashing and which shelters a handle on the backside.

Attention is now directed jointly to FIGS. 1 and 2 of the drawings. Especially as viewed in FIG. 2, the receptacle 10 of the present disclosure is shown in side view to illustrate certain key aspects of the basin. One of the most important aspects is the incorporation of a generally flat bottom 12 to enable the device to sit level or flat on a table or other typical surface. There is a sloping side wall 14 which extends along the back. The sloping side wall is spaced from a sloping front wall 16, the two walls having a slope which is about at the same angle. The front wall extends somewhat taller and is not interrupted until it reaches a top surrounding lip 18. The lip has spaced gussets 20 on the bottom side. These gussets have (2) two functions; first, they create an air space when stacking for ease of separation, and second, they reduce static cling by friction of plastic surfaces rubbing against each other. Indeed, the lip extends upwardly on a side panel 22. The side panel extends to the top edge 24. The top edge is defined along the back or splash wall 26. The back or splash wall 26 extends vertically downwardly.

Going now to FIG. 1 of the drawings more specifically, the curving lip 18 extends forwardly and has a curving central front portion 30 which is somewhat curved to fit against left and right cheeks of the patient to pass just beneath the mouth. This curvature need not be extreme. What is desirable is that the left and right ends of the curving portion 30 extend slightly behind the mouth of the patient. As further shown in FIG. 1, there is an internal region or cavity portion 32 which defines a waste liquid receptacle. The receptacle is located within the sloping walls 14 and 16 previously mentioned.

Figure 3:
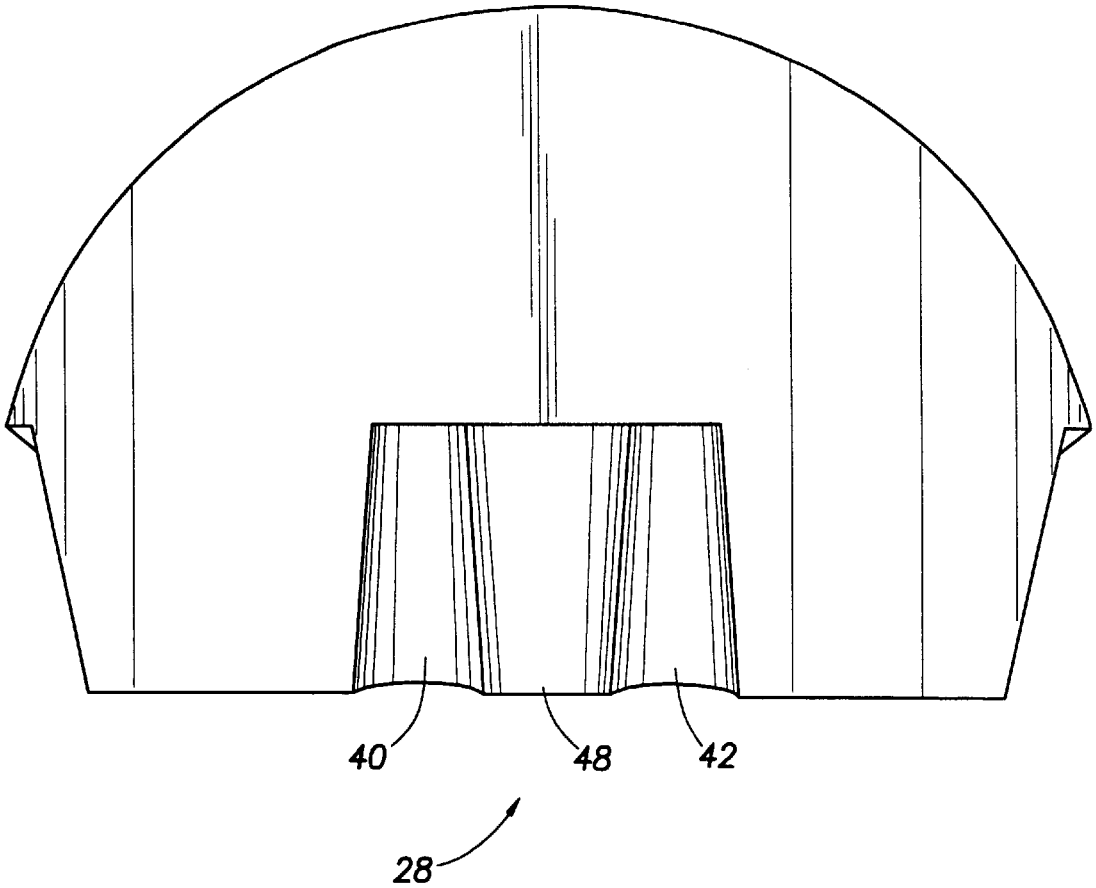
FIG. 3 is a rear view orthogonal to the view of FIG. 2 showing a finger grip handle which includes finger sized notches.

Going now to FIG. 3 of the drawings, the back 26 extends downwardly to the hand grip 28. As will be detailed, the finger grip 28 is made integral with the back upstanding wall 26 and bowl. The finger grip has a width to define a grip which is approximately finger sized. The optimum grip is a pair of notches 40 and 42. They are sufficiently deep to enable the protruding finger grip 48 to be held by a user, or assistant. The hand of the user is received into the pair of flanking notches. The finger grip is integral to the back. There is a taper in the notches (see FIG. 3) from top to bottom.

Going now to FIG. 1 of the drawings, the front lip 18 is curving so it can be positioned immediately in contact with the face of the patient just below the mouth. It is not necessary that greater curvature be incorporated. FIG. 1 of the drawings also shows the back 26 and handle 48 which extend downwardly and taper inwardly at the back wall 26 to enable mold release. As further shown in FIG. 2 of the drawings, the structure includes a perimeter 44 around the bottom 12 previously mentioned. Again, as will be understood, this perimeter defines the edge of the bottom 12 so the bottom has the requisite shape for stacking and nesting.

The device of the present disclosure has a width of about the width of a patient's head and ranges from about eight to twelve inches. The device preferably has a depth from the lip 18 to the bottom 12, shown in FIG. 2 of the drawings, of about three to five inches. The upstanding back 26 stands above the lip 18 by a minimum of about two inches and preferably as much as about six inches. In other words, the top or apex of the lip at 24 in comparison with the lip on the basin indicated in FIG. 2 is up to about six inches taller. To increase the volumetric capacity, the basin can be made deeper, i.e., by positioning the bottom 12 at a greater depth with respect to the lip 18 shown in FIG. 2. Ideally, the device is formed of relatively thin stock which can be any disposable polymer or copolymer plastic in sheet form. A thickness up to about one eight of an inch is permitted, but it is more economical to make the device with thinner walls of approximately 0.02 to about 0.08 inches in thickness. The lip can be made somewhat thicker and the gussets 20 can also be made slightly thicker. This will enhance the strength of the basin The finished product is relatively light, weighing only one or two ounces.

The finger notches 40 and 42 enable the thumb and two or three fingers (of either hand) to grasp the grip region 48. This grip is central and on the centerline of the device. The back view of FIG. 3 shows how the notches taper from smaller to larger at the bottom for mold release. This defines the grip 48 between, indeed, as a mold release. This defines the grip 48 between, indeed, as a continuation of the generally planar back face 26. This grip construction is easily molded, then removed, and can be stacked to store the basin. Past molding assembly is avoided, reducing cost.

Figure 4:
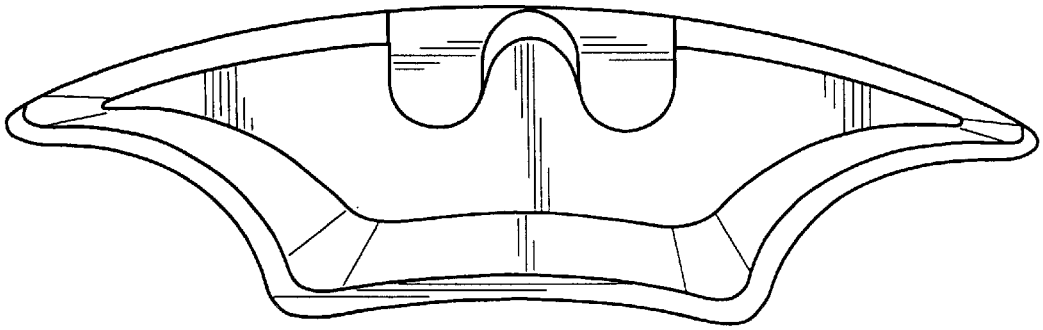
FIG. 4 shows an alternate form of basin including the butterfly shape cooperative with a back located to deflect splashing.

The embodiment of FIG. 4 illustrates the overall butterfly shape of the basin and has a raised back to deflect fluids into the basin. This version has a slightly different back curvature and a slightly different shape or contour for the hand grip.

In summary, the device of the present disclosure is a readily discarded disposable device for catching body fluids from patients who are subject to coughing, sneezing, gagging and vomiting. It is especially useful in securing hospital cleanliness. While the foregoing is directed to the preferred embodiment, the scope is determined by the claims which follow.

What is claimed is:

1. A receptacle for use by sick patients to prevent spitting, sneezing or vomiting in an unrestrained fashion wherein the apparatus comprises a basin having a bottom and an encircling side wall extending there above to define said basin, and said encircling side wall has a front top curving portion approximately conforming to the face of such a patient to contact the face of the patient below the mouth, and said encircling side wall includes an upstanding opposing back wall standing at a height above said front top curving portion to prevent coughing, sneezing or vomiting over said receptacle, and said opposing back wall at said bottom integrally includes a pair of spaced finger receiving notches on two sides of a grip region aligned with a center line of said upstanding opposing wall so that hand gripping is permitted.

2. The receptacle of claim 1 wherein said bottom is flat to enable support on a flat surface, and said encircling side wall slopes at an angle to enable stacking of plural receptacles.

3. The receptacle of claim 2 wherein said opposing back wall curves to a maximum height.

4. The receptacle of claim 3 wherein said said encircling side wall and said upstanding opposing back wall connected thereto curve symmetrically downwardly from said maximum height toward said bottom.

5. The receptacle of claim 4 wherein said notches are tapered upwardly from said bottom.

6. The receptacle of claim 5 including an encircling lip connected to the front top curving portion of said encircling wall for facial contact with a patient.

7. The receptacle of claim 6 including gussets connected to said encircling wall below said lip.

8. The receptacle of claim 7 wherein said receptacle is formed of sheet polymer material having a thickness in the range of about 0.02 to 0.08 inches.

9. The receptacle of claim 7 wherein said gussets are tapered downwardly from said lip thereby controlling spacing on nesting of said basin in another basin.

10. The receptacle of claim 7 wherein said gussets are spaced along said lip and are connected to said to said lip and said encircling side wall.

11. The receptacle of claim 7 wherein said gussets are integrally formed with said lip and basin.

12. The receptacle of claim 1 wherein said opposing back wall connects to a tapered back wall portion of said encircling side wall.

13. The receptacle of claim 12 wherein said finger receiving notches are parallel to said center line.

14. The receptacle of claim 13 wherein said said finger receiving notches extend to said basin bottom.

15. The receptacle of claim 14 wherein said notches taper upwardly from said basin bottom for mold release.

16. The receptacle of claim 15 including an encircling lip connected to the front top curving portion of said encircling wall, and further including gussets adjacent to said encircling lip and spaced along said encircling wall so that said gussets serve to separate stacked receptacles to reduce suction when separating stacked receptacles, to provide air spacing between stacked receptacles, and to provide friction reduction to reduce static cling between stacked receptacles.

17. The receptacle of claim 16 wherein said receptacle is formed of sheet polymer material having a thickness in the range of about 0.02 to 0.08 inches.

* * * * *